United States Patent [19]

Loshaek

[11] 4,002,234

[45] Jan. 11, 1977

[54] CONTACT LENS CONTAINER

[75] Inventor: Samuel Loshaek, Chicago, Ill.

[73] Assignee: Wesley-Jessen Inc., Chicago, Ill.

[22] Filed: Jan. 29, 1975

[21] Appl. No.: 545,024

[52] U.S. Cl. ..... 206/205; 134/137; 206/5.1; 220/304

[51] Int. Cl.[2] ..... A45C 11/04; B65D 81/24

[58] Field of Search ..... 134/117, 137, 143, 166 R; 206/205, 5.1; 220/304, 228, 308, 344, 358, 378

[56] References Cited

UNITED STATES PATENTS

| | | | |
|---|---|---|---|
| 2,876,926 | 3/1959 | Gronemeyer | 220/304 |
| 3,054,412 | 9/1962 | Nickell | 134/137 |
| 3,150,406 | 9/1964 | Obitts | 206/5.1 X |
| 3,367,481 | 2/1968 | Tanaka | 206/5.1 |
| 3,379,200 | 4/1968 | Pennell | 206/5.1 X |
| 3,770,113 | 11/1973 | Thomas | 206/5.1 |
| 3,804,236 | 4/1974 | Tanaka | 206/5.1 X |
| 3,822,780 | 7/1974 | Ulmer et al. | 134/137 X |

FOREIGN PATENTS OR APPLICATIONS

| | | | |
|---|---|---|---|
| 1,342,305 | 9/1963 | Germany | 206/5.1 |
| 47,355 | 7/1973 | Japan | 206/5.1 |
| 1,246 | 1/1974 | Japan | 206/5.1 |
| 13,654 | 2/1974 | Japan | 206/5.1 |

*Primary Examiner*—Steven E. Lipman
*Attorney, Agent, or Firm*—Pennie & Edmonds

[57] ABSTRACT

A container particularly adapted for use in carrying and storing a pair of contact lenses and a storage solution therefor, and also, in a preferred embodiment, serving additionally as part of an autoclaving system for sterilizing the contact lenses, essentially comprises a body member, and a carrier device. The body member is basically comprised of a generally hollow casing member having an open end portion which defines a single access opening therethrough, a closed end portion opposite the open end portion, and a first securing device. In a preferred embodiment, the carrier device includes a single integrally formed member which, in integral combination, comprises a closure portion for completely closing the open end portion, a second securing portion which operatively cooperates with the first securing device whenever in the assembled condition for detachably securing the carrier member to the generally hollow casing member, and lens holding segment which includes at least two adjacent lens receptacle arranged in a tandem relationship each one of which is adapted to firmly hold a respective contact lens.

8 Claims, 6 Drawing Figures

CONTACT LENS CONTAINER

BACKGROUND OF THE INVENTION

1. Field of the Invention

The present invention generally relates to a container device. More particularly, it pertains to a portable container especialy adapted to carry and store a pair of contact lenses.

2. Description of the Prior Art

In the field of contact lenses, it is rather customary to provide a suitable container or receptacle device which serves to enable a wearer of such lenses to conveniently carry and store the same, yet at the same time enable the lenses to be conditioned and identifiably separated whenever not in actual use. Heretofore, in the prior art, numerous constructions have been proposed to provide a portable contact lens container which furnishes such of the aforementioned features.

One somewhat typical prior art container construction generally includes a receptacle which defines isolated chambers at opposite ends thereof. Fitted in each respective chamber is a removable closure member which is adapted to close the opposite ends and includes a contact lens holding device which carries a contact lens. In addition, a conditioning solution which is adapted for cooperating with the contact lenses, in a known fashion, is contained within each of the separated chambers. This particular type of constructional arrangement for a contact lens container, however, suffers from several disadvantages in that by reason of the two chambers and closure members there is an unnecessary duplication of the structural components. Such duplication adds to the overall costs of the lens container. It should be emphasized that the particular field of contact lens containers is rather extremely competitive, and there is somewhat of a narrow or small profit margin associated with the sales of such containers. As a consequence thereof, it will, of course, be appreciated that even slight increases in costs may render a lens container commercially less desirable from a cost standpoint, than competing lens containers.

In addition to the aforenoted relatively expensive container construction, by virtue of two separated chambers there also exists an increased likelihood that some of the storage solution contained thereby may inadvertently leak, or in certain circumstances spill during repeated openings and closings of such containers. In such event, it will, of course, be appreciated that the container will fail to perform one of its intended functions. Although some known approaches in the field utilize sealing elements adjacent each opening, it will be appreciated that the necessity for having two sealing members associated with each container also tends to correspondingly increase the costs thereof. As mentioned previously, and herein stressed, the cost factors are particularly significant in the light that the profit margin in the competitive contact lens container field is small.

Another known prior art approach is described generally in Japanese Pat. Opening No. 1246/1974, wherein a contact lens receptacle has a single access opening and a closure member which carries a pair of contact lenses. In the particular arrangement disclosed, however, such closure member is formed from several individual components which must of necessity be assembled together. Again, the time and labor required to produce and assemble such components are considered to be significant cost factors. Moreover, such closure member is relatively structurally complicated in that it relies on a plurality of fingers to hold the contact lenses and fails to provide a suitable sealing arrangement for preventing leakage of storage solution or the like.

In view of the foregoing comments directed to the various forms of prior art constructions in the field of contact lens containers, it will be appreciated that they suffer from certain shortcomings in that they are relatively complicated in construction and expensive in production.

SUMMARY OF THE INVENTION

It, therefore, becomes an object of the present invention to obviate the previously mentioned disadvantages associated with contact lens containers by providing a novel and improved contact lens container which is reliable in operation, and yet simple in construction and, thusly, relatively economical to competitively manufacture.

Essentially, the present invention contemplates that the novel and improved container be especially adapted for use in storing and carrying contact lenses and a storage solution therefor, and also, in a preferred embodiment, serves a dual function in that it may be used as part of an autoclaving system for sterilizing the lenses. Such container may be comprised of a body means having operatively cooperated therewith a carrier means. The body means is defined by a generally hollow casing member having an open end portion which defines a single access opening therethrough, a closed end portion which is situated opposite the open end portion, and a first securing means, which in a preferred embodiment is defined by an external threaded segment.

In a preferred embodiment, the carrier means consists of a single integrally formed carrier member which includes in integral combination, a closure portion, a second securing means, a lens holding means, and a carrier recess means. The closure portion is arranged adjacent one end of the single carrier member for completely closing the open end of the casing member so that the interior of the hollow casing is inaccessible, whenever the carrier member is in an assembled condition with respect to the hollow casing member. In addition, the closure member is so configured and dimensioned relative to the remainder of the carrier means that whenever the carrier means is inverted the closure member may serve as a convenient support surface for facilitating insertion and removal of the contact lenses from the carrier means. The second securing means is formed adjacent the closure portion and is defined by externally formed threads. The threads of the second securing means serve to threadedly cooperate, in conventional fashion, with the internal threads formed adjacent the open end portion of the hollow casing member. Accordingly, the carrier member may be suitably detachably secured to the hollow casing member. In the preferred embodiment, the lens holding means basically includes at least two adjacent lens receptacle means which are arranged in a tandem or end-to-end relationship with respect to each other. Each of these lens receptacle means is so formed that it is adapted to firmly yet detachably hold a respective contact lens. Preferably, formed adjacent the closure member is a carrier recess portion. Such carrier recess portion serves to enable as well as facilitate the molding of the carrier member as a single integral piece. As a consequence thereof, the single piece carrier member may be economically produced in large volume, as well as provide a carrier member which obviates the necessity of being comprised of several components which would require relatively precise assembling and manufacturing of the same.

As previously indicated, a preferred embodiment of the present invention is intended to serve a dual function in that it may be used as part of an autoclaving system for sterilizing the lenses. In such instances, the container would be suitably externally heated by an oven or a heating block and the like. It is envisioned that the heating block may form part of an apparatus designed to hold the container, such as in a known type of suitable autoclave device which may be used for sterilizing contact lenses.

Additionally, for example, an oven such as of the type utilized in a doctor's office may also be used in association with a plurality of containers of the present invention so as to enable the sterilization of the contact lenses within the closed containers. Should the novel and improved container be used in this dual capacity the material of the container is fabricated so as to be appropriate for the normal temperatures and the pressures generated in an autoclaving process designed for contact lenses.

BRIEF DESCRIPTION OF THE DRAWINGS

These and other objects, features, and advantages of the present invention will become readily apparent upon a reading of the detailed description of the preferred embodiment when made in accordance with the principles of the present invention when viewed in conjunction with the accompanying drawings wherein like reference numerals indicate like structure throughout the several views.

DETAILED DESCRIPTION OF THE PREFERRED EMBODIMENT

Figure 1:
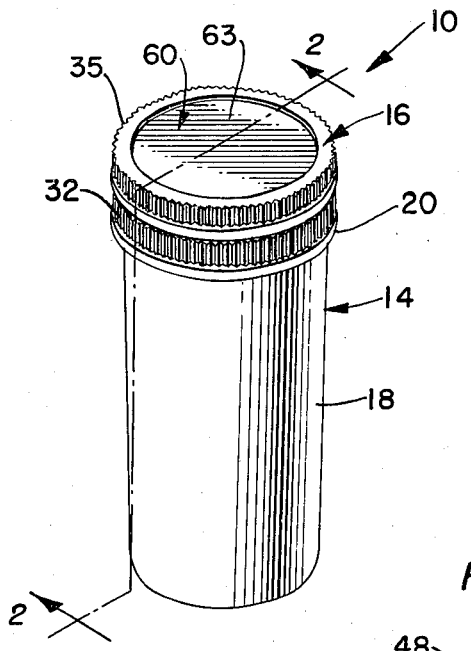
FIG. 1 is a perspective view of a novel and improved contact lens container embodying the principles of the present invention and is illustrated in the assembled condition.

Referring now to the FIGURES of the drawings, there is disclosed a novel and improved contact lens container or receptacle embodying the principles of the present invention and being designated generally by reference numeral 10. Such contact lens container 10 will ordinarily serve to conveniently store as well as enable a wearer to carry, for example, a pair of generally elastic and flexible contact lenses which are generally indicated by reference numeral 12. Such contact lenses 12 are by virtue of their construction known as of the "soft" lens type. Although the "soft" type of contact lenses 12 will be described for use in conjunction with the contact lens container 10, it will, of course, be appreciated that the other types of contact lenses may also be suitably stored and carried by the container of the present invention. Additionally, of course, the container will function to sealingly carry fluid and, in manner to be more fully described, serve as an autoclave.

Basically, the contact lens container 10 is contemplated as including body means 14 and removably associated therewith a carrier means 16 which serves to, in a manner to be more fully described, separately carry each of the respective contact lenses 12.

Figure 2:
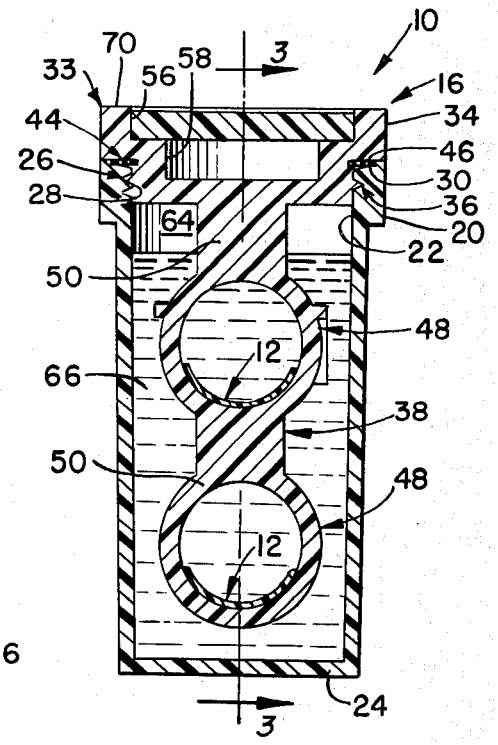
FIG. 2 is a sectional side elevational view taken substantially along section line 2—2 in FIG. 1 looking in the direction of the arrows and illustrating greater details of the structure of such new and improved contact lens container.
Figure 3:
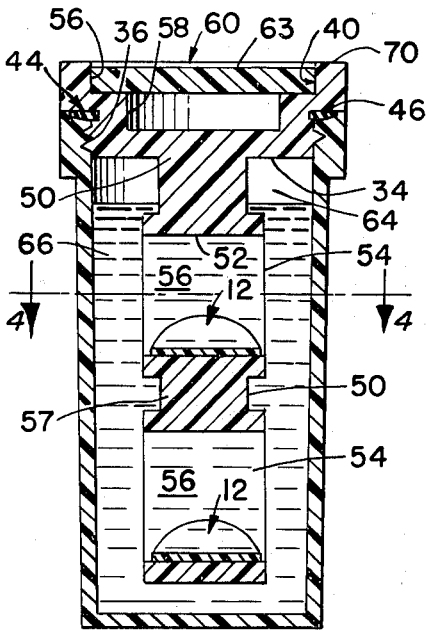
FIG. 3 is a sectional side elevational view taken substantially along section line 3—3 appearing in FIG. 2 and looking in the direction of the arrows illustrating another view of the novel and improved contact lens container made in accordance with the principles of the present invention.
Figure 5:
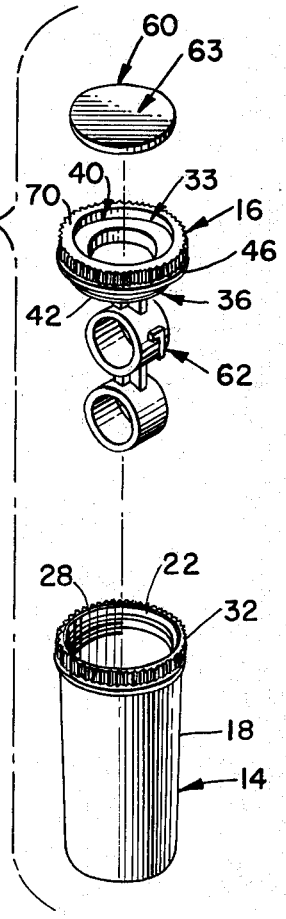
FIG. 5 is an exploded perspective view of the various components defining the contact lens container made in accordance with the principles of the present invention.

As perhaps best depicted in FIG. 2 taken in conjunction with FIGS. 3 and 5, it will be noted that the body means 14 comprises a generally hollow body or casing member 18 having an open end portion 20 which defines a single access opening 22 for the hollow casing member 18, closed end portion 24, and first securing means 26.

The single access opening 22 is of particular usefulness by reason of the fact that it tends to minimize any possible spillage or leakage as compared with double opening type containers. Moreover, whenever the container 10 is utilized as an autoclave it will be appreciated, of course, that a single opening provides less of a likelihood that container closures would fail whenever the relatively elevated temperatures and pressures are reached.

First securing means 26 may be defined by a conventionally formed internal screw threaded segment 28 located adjacent the opening of the open end portion 20. Such internal screw threaded segment 28 will suitably, in a manner to be described presently, operatively cooperate with the carrier means 16 to detachably secure the carrier means 16 to the body means 14. A generally annular container recess 30 is formed at the forwardmost portion of open end portion 20 and may be formed generally above the internal threaded segment 28. The particular significance of this generally annular container recess 30 will be more fully described in the succeeding description of the present invention. With particular reference to FIGS. 1 and 5 it will be noted that the external peripheral surface of the open end portion 20 is defined by a plurality of peripheral serrations 32 which facilitate the assembling and disassembling of the container 10 by permitting a user thereof to more firmly grip the lens container.

With particular reference to FIGS. 2, 3 and 5, the carrier means 16 of the preferred embodiment is more fully depicted. In the illustrated embodiment, the carrier means 16 includes a single integrally formed continuous carrier member 33 which comprises, in integral combination, closure portion 34, second securing means 36, lens holding means 38, and carrier recess means 40.

The closure portion 34 is basically defined by an enlarged head section which is appropriately constructed and dimensioned to suitably close off the single access opening 22 and is provided with peripheral serrations 35 similar in structure and function to serrations 32. Accordingly, whenever body means 14 and carrier means 16 are assembled together, such as in the manner more clearly indicated in FIGS. 2 and 3, a relatively tightly closed container 10 is formed. As will be afterwards discussed in greater detail, especially in connection with FIG. 6, the closure portion 34 enables the carrier means 16 to be stable whenever in an inverted position thereby facilitating a user thereof to quickly and easily insert and remove the lenses 12. With respect to the second securing means 36 of the present invention, it will be observed that it may be defined by an externally threaded segment 42 which is formed in an appropriate and suitable manner. Such external threaded segment 42 is envisioned to threadedly cooperate, in a conventional fashion, with the internal threaded segment 28 formed internally of the open end section portion 20 of the casing member 18. It will, therefore, be appreciated that to conveniently assemble or disassemble the contact lens container 10 one merely has to threadedly fasten or unfasten first securing means 26 with respect to the second securing means 36 in an appropriate manner.

As more clearly shown in FIG. 2 and 3 a preferred embodiment of the carrier means 16 may include a sealing means 44. Sealing means 44 may be comprised of generally annular sealing member 46 which is adapted to be secured in a suitable manner to the closure portion 34 of the carrier means 16. Such generally annular sealing member 46 is dimensioned to be appropriately snugly received within the container recess 30 formed in open end portion 20. In this particular arrangement, the sealing member 46 will be enabled to provide a fluid-tight fit with respect to casing member 18, whenever first and second securing means 26 and 36, respectively, are fastened together. In addition, the sealing member 46 should be made so as to withstand the pressure and temperature which it will be subjected to whenever the container 10 serves as an autoclave. Although this particular embodiment has disclosed and described the annular sealing member 46 being carried by the closure portion 34, it is to be understood, of course, that the principles of the present invention envision that each sealing member 46 may be suitably mounted on and secured to the open end portion 20 of casing member 18. With such a construction, however, a suitable recess equivalent to container recess 30 may be correspondingly formed in the closure portion 34 of carrier means 16.

Figure 4:
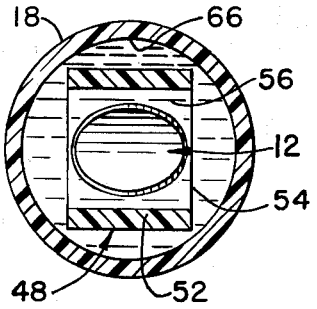
FIG. 4 is a sectional view taken substantially along section line 4—4 appearing in FIG. 3 looking in the direction of the arrows and illustrating a manner by which one of the contact lenses is carried and stored in the contact lens container of the present invention.

With specific reference to FIGS. 2, 3 and 5, the lens holding means 38 may be defined by a pair of receptacle means 48 which extend in a generally linear end-to-end relationship, and stem portions 50. This end-to-end or tandem arrangement of the receptacle means 48 enables both of the contact lenses 12 to be carried in a convenient manner by single carrier member 33. Each of stem portions 50 are effective to serve to integrally connect the two receptacle means 48 to each other and to the closure portion 34. Further, each of such receptacle means 48 may be essentially defined by generally tubular portion 52 which defines therethrough a lens receiving opening 54 having an axis which is generally transverse to the longitudinal axis extending through the lens holding means 38. Receiving openings 54 have a diameter which may be selected so as to firmly retain the contact lenses 12 therein. Since each of the lens receiving openings 54 formed in tubular member 52 is generally annular in configuration they will provide generally contoured surfaces 56 for receiving therein a respective one of the contact lenses 12. Moreover, the diameter of each of the openings 54 is so dimensioned that it is relatively smaller than the normal unflexed size of the contact lens 12. In this particular fashion, it will be understood that since the contact lens 12 may be of the generally "soft" type, such dimension would require that the lens be somewhat folded prior to insertion into tubular portion 52. Thusly, by reason of the fact that the lenses 12 are inherently resilient they, in attempting to return to their normal or unflexed condition, will non-yieldingly contact as well as assume the general configuration of contoured surfaces 56, such as in the manner indicated in FIGS. 2–4. Accordingly, contact lenses 12 maintain such position and will, therefore, not tend to slide from tubular portions 52. While the contact lenses 12 of the drawings are shown carried in one particular configuration, it should be pointed out that such lenses 12 may assume other positions with respect to the tubular portions 52. Additionally, the respective receptacle means 48 may also assume other configurations and have suitable dimensions dependent, of course, upon the kinds and sizes of contact lenses which are desired to be carried and stored within the contact lens container 10.

Referring to the carrier recess means 40 of the present invention, such recess means may perhaps be best depicted in FIG. 2 taken along with FIGS. 3 and 5. As therein denoted, such carrier recess means 40 may be formed in the closure member 34. In one preferred embodiment, it may be defined by first and second generally concentric cutout portions 56 and 58, respectively. First cutout portion 56 may be larger than the second cutout portion 58 and so dimensioned as to snugly receive therein a lid member 60. Although the recess means 40 has been described as including cutout portions 56 and 58, it should be noted that any other suitable configuration may be formed. The purpose served by the carrier recess means 40 is to permit carrier means 16 to be simply, easily, and economically molded into a single integral member. Accordingly, the carrier means 16 need not be fabricated from several different components. In addition, it may be manufactured in a single and simple molding process.

As perhaps best depicted in FIG. 5, indicia means 62 may be formed on an appropriate portion of the receptacle means 48 for facilitating the identification and separation of contact lenses 12 for subsequent use by the wearer in a known manner.

Referring again to the lid member 60, such may be defined in a generally flat circular disc which is adapted to be suitably secured within the first cutout portion 56 in any convenient manner. Such lid member 60 may include an outwardly disposed surface 63 upon which appropriate forms of indicia may be placed for purposes of identification or the like.

Whenever the carrier member 33 is threadedly received within the casing member 18, such as in the assembled condition, the seal member 46 sealingly cooperates with container recess 30 so that a virtually fluid-tight compartment 64 is formed. Compartment 64 normally serves to contain a conventional type of contact lens solution which is generally indicated by reference numeral 66. Typically such solution 66 may be described as a storage/soaking/rinsing solution which is adapted to cooperate in a known fashion with the contact lenses 12 so as to keep the latter hydrated, at the proper osmolarity (i.e., the solution is a buffered salt solution), and to keep the lenses in a antibacterial solution. In addition, the storage solution is used to rinse the lenses 12 after cleaning with a gel-like cleaner. Since the tubular portions 52 are in open communication with solution 66, the solution may freely communicate therethrough with at least a portion of the surfaces of the contact lenses 12. In addition, by reason of the fact that only single access opening 22 is provided, there results a diminished tendency for fluid leakage to occur not to mention the decreased costs associated with fabricating only one sealing element.

Of course, it will be appreciated that whenever it is desired to remove the carrier means 16 and thereby the contact lenses 12 from the body means 14, first and second securing means 26 and 36, respectively, are threadedly unfastened to thereby enable carrier means 16 to be withdrawn from casing member 18.

Figure 6:
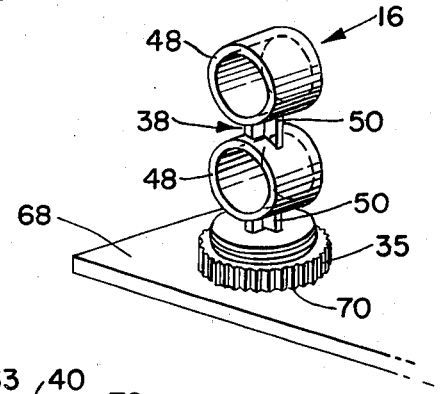
FIG. 6 is a perspective view of the carrier means of the present invention shown in an inverted position on a support structure.

With respect to FIG. 6, whenever the carrier means 16 is in an inverted condition, it may rest on any suitable flat surface 68 such as for example, a table. In such a position, it will be appreciated that the user of the contact lenses 12 will be enabled to set the carrier means 16 on a convenient surface, thereby freeing him to appropriately handle the lenses 12. Since the lid member 60 has a generally flat surface 63, and closure portion 34 similarly possesses a generally flat annular rim surface 70, such positioning is possible.

As mentioned earlier, the novel and improved container 10 of the present invention may serve a dual function in that it may also be successfully utilized as part of an autoclaving system for sterilizing the lenses 12. If used in such a manner, the container 10 and lenses 12 will be subjected to temperatures in the order of about 121°C. and at about 15 psi guage pressure. In this particular embodiment, the container 10 would be heated externally as in an over or by a heating block. A suitable oven may be of the type typically used in a doctor's office and can receive plurality of such containers 10 for sterilizing contact lenses. If, for example, the container is to externally heated by virtue of a heating block, such heating block may be part of an apparatus especially designed to hold the container 10, as in a known type of autoclave device which may be used for contact lenses and the like. After completion of the autoclaving process, the contact lenses 12 will remain sterilized until container 10 is eventually opened since the container 10 is suitably sealed by reason of the seal member 46. As is believed quite evident, the container in this embodiment serves a dual function. To provide a container 10 which can adequately withstand the aforenoted working conditions a suitable material should be selected. Since it is preferred that the container 10 and especially the carrier means 16 be molded, any suitable type of plastic material which would successfully function under the conditions aforedescribed may be employed. One particular example of such a suitable plastic material with which the container may be fabricated from is a polysulfone resin. Although it has been indicated that a plastic material is preferred, it is, of course , envisioned by the principles of the present invention that other suitable and equivalent materials, such as aluminum may be utilized. On the other hand, if the container 10 is merely to be used as a vehicle to hold the lenses 12 for boiling, wherein the temperature it will be subjected to is approximately 100° C., and a 0 guage pressure, a different material, such as polycarbonate may be utilized. Of course, if the container 10 will not be employed for autoclaving or boiling then, for example, an ordinary plastic such as polystyrene or ABS (acrylonitrilebutadiene styrene) may be used.

Having described a preferred constructional arrangement of a contact lens container 10 made in accordance with the principles of the present invention, it is believed that its operation and function are readily apparent.

While the invention has been described in connection with a preferred embodiment, it is not intended to limit the invention to the particular form set forth, but, on the contrary, it is intended to cover such alternatives, modifications, and equivalents as may be included within the spirit and scope of the invention as defined by the appended claims.

What is claimed is:

1. A container particularly adapted for use in carrying and storing a pair of contact lenses and a storage solution therefor comprising a body means which includes a generally hollow casing member having an open end portion defining a single access opening therethrough, a closed end portion opposite said open end, and first securing means located adjacent said opening; and a carrier means which includes a single integrally formed member, which comprises in integral combination, a closure portion for completely closing said open end whenever in an assembled condition, a second securing means operatively cooperating with said first securing means whenever in the assembled condition for detachably securing said carrier means to said body means, and lens holding means including at least two adjacent lens receptacle means arranged in a tandem relationship, each one of which enables a respective contact lens to be firmly held thereby, said carrier means is formed with a carrier recess means in said cover portion for enabling and facilitating molding of said carrier means in a single, continuous and integral member, and a lid member having an outwardly disposed surface adapted for being snugly received within said carrier recess means such that said outwardly disposed surface faces exteriorly whenever said lid member is received with said carrier recess means.

2. A container as set forth in claim 1 in which said body means, said carrier means, and said lid member are fabricated from a suitable material which will enable said container to additionally be used as part of an autoclaving system.

3. A container as set forth in claim 2 in which said material is comprised of a polysulfone resin.

4. A container particularly adapted for use in carrying and storing a pair of elastic contact lenses and a storage solution therefor comprising a body means including a generally hollow casing member having an open end portion defining a single access opening into said casing member, a closed end portion opposite said open end portion, a recess in said open end portion, and first securing means including an internally threaded segment; and carrier means which includes a single integrally formed member which comprises, in integral combination, a closure portion for completely closing said open end and thereby said single opening whenever in an assembled condition, a second securing means including an externally threaded segment for detachably securing said carrier means to said body means, lens holding means including at least two adjacent lens receptacle means arranged in a tandem or end-to-end relationship, each one of which firmly and removably holds a respective contact lens, and carrier recess means formed in said closure portion for enabling and facilitating molding of said carrier means in a single continuous member, each of said receptacle means including a generally tubular portion having an axis which is generally transverse to a longitudinal axis of said carrier means, each of said tubular portions defining a passage therethrough for receiving a respective one of the contact lenses and for enabling a cleaning solution to freely pass therethrough, each of said annular passages has a diameter which is less in dimension than the diameter of a respective one of the contact lenses in an unflexed condition, such that whenever a respective one of the contact lenses is inserted into said passage, said passage by virtue of said diameter snugly retains the flexible contact lens therein by maintaining the contact lens in a flexed condition, and a seal means connected to said carrier means for sealingly cooperating with said recess in said open end portion to thereby provide a fluid-tight seal adjacent said single opening defined by said open end portion; and a lid member having an outwardly disposed surface and being adapted for being snugly received within said carrier recess means for enabling the application of indicia or the like thereon.

5. A container as set forth in claim 4 in which said body means, said carrier means, and said lid member are fabricated from a material which will enable said container to be used as part of an autoclave system.

6. A container as set forth in claim 5 in which said material is comprised of a polysulfone resin.

7. A container as set forth in claim 4 in which said body means, said carrier means, and said lid member are fabricated from polycarbonate.

8. A container as set forth in claim 4 in which said body means, said carrier means, and said lid member are fabricated from polystyrene.

* * * * *